United States Patent [19]

Germane et al.

[11] Patent Number: 4,583,991

[45] Date of Patent: Apr. 22, 1986

[54] NITROMETHANE FUEL COMPOSITIONS

[75] Inventors: Geoff J. Germane, Orem, Utah; Gary L. Hess, Downers Grove, Ill.

[73] Assignee: Angus Chemical Company, Northbrook, Ill.

[21] Appl. No.: 756,767

[22] Filed: Jul. 17, 1985

[51] Int. Cl.[4] ..... C10L 1/22

[52] U.S. Cl. ..... 44/72; 568/947; 568/948

[58] Field of Search ..... 568/947, 948; 44/72

[56] References Cited

U.S. PATENT DOCUMENTS 2,071,122 2/1937 Hass et al. ..... 568/947

2,105,581 1/1938 Bender ..... 568/947

4,328,005 5/1982 Frankel et al. ..... 44/72

FOREIGN PATENT DOCUMENTS 0102181 7/1983 European Pat. Off. .

*Primary Examiner*—Y. Harris-Smith

*Attorney, Agent, or Firm*—Leydig, Voit & Mayer, Ltd.

[57] ABSTRACT

The tendency of nitromethane to detonate when used as a fuel in an internal combustion engine surprisingly has been found to be reduced by adding to the fuel a detonation reducing amount of an additive selected from the group consisting of nitroethane, 2-nitropropane, and mixtures thereof. Nitromethane fuel compositions having a reduced tendency to detonate are also provided.

13 Claims, 7 Drawing Figures

NITROMETHANE FUEL COMPOSITIONS

FIELD OF THE INVENTION

This invention relates to nitromethane fuel compositions and to a method for reducing the detonation tendency of nitromethane when used as a fuel in an internal combustion engine.

BACKGROUND OF THE INVENTION

Nitromethane which was used during the late 1940's as a rocket monopropellant, has been used in racing as a fuel for over 30 years. The use of fuels which carry a bonded oxygen in their chemical formula is sometimes referred to as "thermal charging" and is a quick and relatively inexpensive method for increasing the available energy for combustion, provided that the heating value of the fuel does not decrease more than the decrease in the air-to-fuel ratio, as compared with fuels which contain no oxygen.

Although the use of nitromethane significantly increases the horsepower of an internal combustion engine, when compared, for example, with the same engine using a classical gasoline mixture, the tendency of nitromethane to detonate creates a substantial problem for its use. Uncontrolled detonation in an internal combustion engine can, of course, lead to its destruction.

In order to understand the problem of detonation, one must first appreciate that in an internal combustion engine, the flame which is initiated by the spark travels across the combustion chamber at a given velocity, usually about 200 feet per second. As the flame front progresses across the combustion chamber, the remaining gases, termed end gasses, are compressed by the rising pressure, resulting in higher gas temperatures and densities. If these gas temperatures exceed the self-ignition temperature of the air-gas mixture and, if the gas remains at such a temperature longer than its ignition-delay period, auto-ignition will occur. The auto-ignition, or detonation, can then generate pressure waves which may be an order of magnitude as fast as those in normal combustion.

Because nitromethane has a lower auto-ignition temperature than gasoline, detonation becomes the limiting factor in its use as a fuel for an internal combustion engine. Detonation, even when not severe, results in the engine audibly knocking which in itself is distracting. However, besides the audible noises generated by the detonation, the pressure waves which are induced by the detonation penetrate what typically exist in the form of a boundary layers along the cylinder walls which generally insulate the combustion chamber from the hot combustion gasses. As the boundary layer is scrubbed away, the heat losses from combustion products to the engine are increased, thereby reducing the useful energy in the cylinder. Also, repeated detonation may generate a hot region in the combustion chamber, as at the spark plug electrode, causing pre-ignition. When pre-ignition occurs, even higher temperatures and pressures are encountered in the combustion chamber, thus further aggravating the detonation problem. Thus, detonation and pre-ignition can become self-perpetuating.

As stated previously, severe detonation over a sustained period of time can substantially damage engine parts, such as pistons, valves, rings, and cylinder heads.

As auto-ignition is caused by explosion of the end gas, conditions which promote the explosion of the end gas, such as higher temperatures, increased density, increased exposure time of the unburned mixture, and the mixture composition itself, aggravate the problem.

Thus, although nitromethane offers the potential of substantially greater power than gasoline, when burned in an internal combustion engine, the problems associated with the tendency of nitromethane to detonate detracts substantially from its use as a fuel. To date, the only solution to the detonation problem has been the addition of methanol to the nitromethane fuel which acts to "cool" the burn of the nitromethane and thus to decrease its propensity to detonate. The problem with the addition of methanol, however, is that although the tendency to detonate is reduced, the addition of the methanol also substantially decreases the amount of energy which is obtained from the fuel formulation.

There thus exists a need for an additive for nitromethane which would decrease its tendency to detonate when burned in an internal combustion engine, while preserving, to the extent possible, the high specific energy of nitromethane.

SUMMARY OF THE INVENTION

It has now been quite surprisingly found that the tendency of nitromethane to detonate in an internal combustion engine can be appreciably reduced by the use of nitroethane, nitropropane, or a mixture thereof. Accordingly, the present invention provides a method for reducing the tendency of nitromethane to detonate when used as a fuel in an internal combustion engine, comprising adding to the nitromethane a sufficient amount of an additive selected from the group consisting of nitroethane, 2-nitropropane, and mixtures thereof, to achieve such a redution in detonation.

The present invention also provides a nitromethane fuel composition which comprises, by weight, from about 75 to about 99 percent nitromethane and from about 1 to about 25 percent of an antidetonation additive selected from the group consisting of nitroethane, nitropropane, and mixtures thereof.

DETAILED DESCRIPTION OF THE PREFERRED EMBODIMENTS

Figure 1:
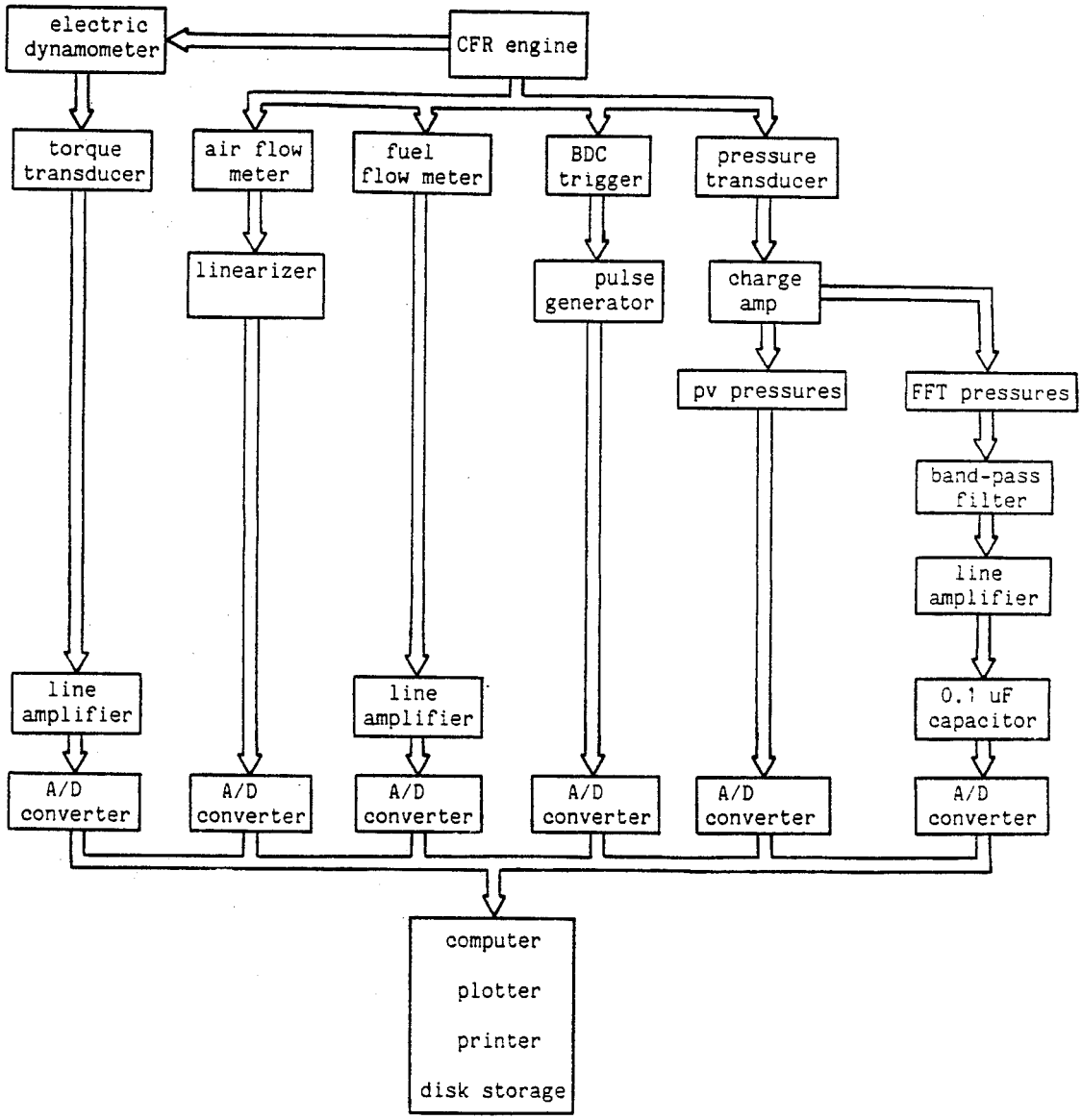
FIG. 1 is a schematic of an engine test cell used to test the fuel compositions of the present invention.

As previously indicated, the present invention provides a method for substantially maintaining the high specific energy of nitromethane while reducing its tendency to detonate. It will be appreciated by one skilled in the art that numerous factors affect the detonation properties of a given fuel in an engine, including engine compression ratio, engine timing, and the mixture equivalence ratio which is the actual air-to-fuel ratio divided by the the stoichiometric air-to-fuel ratio. Altering any of the aforementioned parameters would necessarily have an effect upon the tendency of any fuel to detonate.

As nitromethane as a fuel is typically used in supercharged engines having static compression ratios from about 5:1 to about 7:1, the experimental results discussed below were performed on a test engine having a compression ratio of 5:1.

The antidetonation additives of the present invention, as discussed above, are nitroethane, 2-nitropropane, and mixtures thereof. Typically, the antidetonation additive will be used in an amount from about 1 to about 25 percent, by weight, based upon the total weight of the nitromethane and additive. More preferably, the amount of additive which is employed will be from about 5 to about 15 percent, most preferably about 10 percent, again based upon the total weight of the nitromethane and additive. A generally employed fuel composition would normally contain about 10 percent of the additive and about 90 percent of the nitromethane.

Nitromethane as used in the present invention is meant to refer to nitromethane as is commercially available along with any impurities which may be present therein. It is understood that the typical commercial nitromethane contains some small percentage of higher nitroalkanes as impurities. Thus, the present invention is based upon the addition of the antidetonation additives as discussed herein, to the commercially available nitromethane which may already have present as impurities some small amount of higher nitroalkanes, such as nitroethane and nitropropane.

Of course, as the nitromethane containing the antiknock additive of the present invention is employed as a fuel in an internal combustion engine, other additives may additionally be present in the fuel, such as corrosion inhibitors, lubricants, antiwear additives, and the like. Such additional additives, if present, are typically employed in an extremely low level. The use of such additives is well within the skill of one in the art. The present invention will be illustrated in further detail by the following examples which are not meant to be limitations upon the scope of the present invention.

EXAMPLES 1-10

To demonstrate the efficacy of the present invention, ten fuel compositions were tested as discussed below. The composition of each of the ten fuels is shown in Table 1. Examples 1 and 6 are simply controls in which methanol was employed as the sole fuel for the purpose of determining a base comparison point. As the examples containing nitroethane and 2-nitropropane were run at different times, a new control was run before each of the series. Examples 2 and 7 employ 100 percent of an additive of the present invention, nitroethane and 2-nitropropane, respectively, for the purpose of determining each additive's performance as a neat fuel. Examples 3 through 5 are thus related to the use of nitroethane as an antiknock additive in nitromethane and examples 8 through 10 are related to the use of 2-nitropropane as an antiknock additive in nitromethane.

TABLE 1

| Example | Nitromethane (%) | Nitroethane (%) | Nitropropane (%) | Methanol (%) |
|---|---|---|---|---|
| I | 0 | 0 | 0 | 100 |
| II | 0 | 100 | 0 | 0 |

TABLE 1-continued

| Example | Nitromethane (%) | Nitroethane (%) | Nitropropane (%) | Methanol (%) |
|---|---|---|---|---|
| III | 20 | 80 | 0 | 0 |
| IV | 30 | 70 | 0 | 0 |
| V | 40 | 60 | 0 | 0 |
| VI | 0 | 0 | 0 | 100 |
| VII | 0 | 0 | 100 | 0 |
| VIII | 20 | 0 | 80 | 0 |
| IX | 40 | 0 | 60 | 0 |
| X | 60 | 0 | 40 | 0 |

For all of the tests performed on the aforementioned fuel compositions, a compression ratio of 5:1 was used, with the timing set at 30° before top dead center, and at an equivalence ratio of 0.8.

The testing of the fuel compositions listed in Table 1 was performed on an engine test cell which contained a Waukesha ASTM-CFR Model 48 Engine, connected to a Louis Allis ON A Cradle mounted to an electrical dynamometer. A schematic of the engine test cell and instrumentation is shown in FIG. 1.

The signals from the instrumentation were input into a Hewlett-Packard (HP) 6942A multiprogrammer, which contained the cards necessary for scanning and for analog to digital (A-D) conversion. A HP 9626A computer was used to collect and reduce the data. The computer was interfaced with a HP 2671G thermal printer and a HP 7475A graphics plotter, so that hard copies of the test results could be obtained.

A PCB 113A (sn #3182) quartz piezoelectric transducer was coated with heat resistant silicon jelly, and was then mounted in a water cooled jacket in the cylinder head. The transducer output was input to an Endevco 2740B charge amplifier. At this point two different data paths for the pressure signals were used (these two paths will be discussed in detail in the Analytical Method section of this report). One path simply routed the charge amplifier output to the A/D converter. The other path input the charge amplifier output to an SKL model 302 electronic band-pass filter to isolate the frequencies between 3 and 7 KHz. (The isolation of these frequencies will also be discussed in the Analytical Approach section). The filtered pressure signals were next input to a Dynamics 7600/LLM line amplifier for further amplification, and then input to a 0.1 $\mu$F capacitor to eliminate some drift induced by the filter. Finally, these filtered and boosted pressure signals were input to the A/D converter.

A Fluidyne model 213 four-piston rotary flow meter was used to monitor fuel-flow. The flow transducer was magnetically coupled to a Fluidyne model 284-220 photo-optic pulse generator. The digital pulses were counted by the HP 9826 computer, and converted to fuel flow in the data reduction program.

A Thermo-Systems Incorporated (TSI) model 2017 hot wire anemometer was used to measure air flow. A TSI model 62 signal conditioner was used to linearize the flow meter signal.

As mentioned previously, the engine was connected to an electric dynamometer. An Interface 25-pound force transducer was mounted to the dynamometer in order for torque readings to be input directly to the computer. The voltage signals from the transducer were amplified by a Valadyne MCI-3 amplifier.

While the engine was stopped, and at bottom-dead center, a metal tab was mounted on the camshaft. A magnetic inductor was fastened to an adjustable bracket, which in turn was mounted above the metal tab. As the engine rotated and the metal tab passed by the inductor, a small electrical pulse was generated which corresponded to bottom-dead center. The signal induced by the magnetic pickup was routed through a Wavetek 145 pulse generator to obtain a true TTL output, which was necessary to trigger the computer.

A Tektronix rotational function generator was used to determine cylinder volume at any given time. The function generator output a specific voltage corresponding to degrees of crankshaft rotation. The voltages were converted to swept volume in the software.

As mentioned briefly in the previous section, one set of pressure signals was input from the charge amplifier directly to the A-D converter. These pressures were used in conjunction with swept volume to calculate indicated work and indicated mean effective pressure (imep). To calculate indicated work and imep it was necessary to know the swept volume that corresponded to each pressure. The computer had a maximum sample time of 25 KHz., but each input channel had to be scanned serially. Therefore, the maximum sample time would have been 12.5 KHz. ($\frac{1}{2}$ of 25 KHz.) if only one channel of cylinder and one channel of volume had been scanned. Since higher resolution was desired for cylinder pressure, another method was devised. The pressure input was split into 5 channels, and volume was input as the 6th channel. The computer repeatedly scanned the 5 pressure channels, and then the volume channel. This gave a resolution of 20.8 KHz. (5/8 of 25 KHz.) for cylinder pressure and 4.2 KHz. (1/6 of 25 KHz.) for swept volume. Since the engine speed was approximately constant at 1000 rpm, the 42 KHz. resolution of swept volume gave over 120 volume points from BTC to TDC. Finally, the three cylinder pressures sampled before each volume signal and the three pressures samples after each volume signal were average together to give a mean pressure reading corresponding to every swept volume point.

The other set of cylinder pressures was filtered and further amplified before being input to the A-D converter, and these pressures were used to quantify detonation. The band-pass filter was set to eliminate frequencies below 3 KHz. and above 7 KHz., since several authors have stated that knock occurs in this frequency spectrum (12, 13, 14, 15). These filtered pressures were used for the detonation analysis only, and volume measurements were not necessary; therefore, the pressures were sampled at the full 25 KHz. limit of the computer facility.

Once knock had been isolated by band-pass filtering the 3–7 KHz. frequency spectrum of cylinder pressures, it needed to be characterized so that relative detonation intensity could be measured. One common way to analyze knock is by the time rate of pressure change (dP/dt) [14]. This is an effective method of studying detonation; however, it requires extensive curve fitting between successive pressure points in order to insure that the derivative will be defined throughout the entire spectrum.

Another way to analyze knock is in the frequency domain, rather than in the time domain. The Fast Fourier Transform (FFT) is an effective way to convert time data into frequency data, and was used in this study. The FFT works well with periodic phenomena such as the sine and cosine functions, but some adjustment must be made to non-periodic inputs, such as combustion pressure signals. Through the use of a "window" non-periodic functions can be made to appear periodic. The window is simply a multiplier that scales the input data so that the endpoints are zero. The combustion pressure signals obtained from the CFR engine were scaled in such a manner prior to their input into the Fast Fourier Transform.

Figure 2:
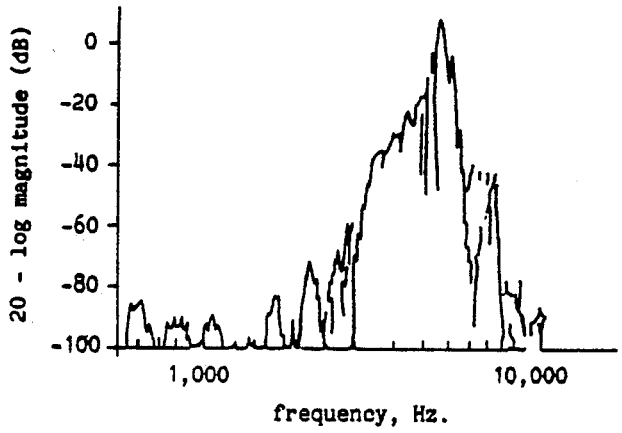
FIG. 2 is a typical output of a Fourier Transfrom performed on a portion of a combustion pressure signal obtained from a test engine, used to determine severity of detonation.

FIG. 2 is a typical output of a Fourier Transform performed on windowed combustion pressured signals obtained from the engine. It was necessary to quantify the severity of detonation in the various tests by some means other than subjective visual observation of the Db versus frequency plots. The area of Db versus frequency plot corresponded to visual observation for every test run, and was therefore chosen to quantify the severity of knock for the tests conducted in this study. This area will be referred to herein as the "isolated spectral area."

This spectral area was calculated by a software program which is described below. The trapezoidal rule was used to determine the area. It was also possible to select the frequency interval over which the integral was to take place. In all cases in this study the interval 3 to 7 KHz. was chosen.

A technique was employed to avoid performing Fourier Transforms on non-representative cylinder pressures, such as those sampled during engine misfire. First, the five filtered and amplified cylinder pressure arrays were plotted on the computer screen as pressure versus time. The program then asked which of the five arrays were to be used in the Fourier Transform. Since pressures obtained during engine misfire were easily detected, they could be selectively removed. Generally no more than two of the pressure arrays were discarded; if more than three were to be discarded then the test was run again. Finally, Fourier Transforms of the selected arrays were performed, and the results were averaged together in the frequency domain before the isolated spectral area was computed.

Figure 3:
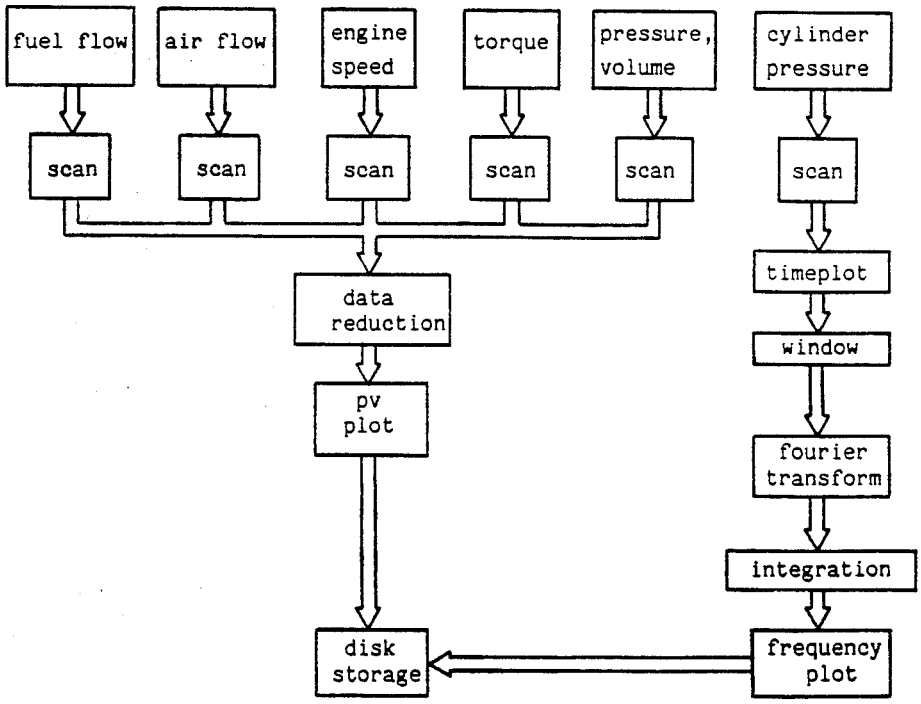
FIG. 3 is a diagram of the software program used in the testing of the compositions of the present invention.

The software used in this research controlled the sampling of data from the engine, and converted the voltages obtained from the sampling to meaningful physical values. The program calculated important engine parameters, such as brake and indicated horsepower, brake and indicated mean effective pressure, air-to-fuel ration, and volumetric efficiency. It also quantified the detonation severity from the different test cases. FIG. 3 is a diagram of the test program.

An existing scanning subroutine was integrated into the data collection program used in this research. The program waited for the bottom-dead center trigger from the pulse generator, and then began sampling one or more of nine channels. The subroutine allowed control over sample frequency, number of samples, and starting and stopping channels. The digital values of the voltages obtained from each scan were stored in their corresponding array. For example, during the cylinder pressure scan, five different arrays of 2048 pressure signals each were obtained. These five arrays were used for the Fast Fourier Transform subroutine.

Once all of the channels were scanned and the respective arrays were filled, the engine was shut off. Each array was then passed through a conversion subroutine to convert voltages obtained from the instrumentation to physical values such as pressure in psi volume in cubic inches, and torque in foot-pounds. Finally, these physical values were used to calculate such results as equivalence ratio. Air-to-fuel ratio, and brake and indicated horsepower and mean effective pressure in a data reduction subroutine.

The filtered cylinder pressure signals were sent through a series of subroutines to convert them from the time domain to the frequency domain. The first of these subroutines windowed the time data. Next the actual FFT was performed on the windowed data, and then the data were run through an integration routine, so that a numerical value could be assigned to the severity of the detonation. Finally, the data were sent to a plotting routine, which plotted the magnitude of the pressure signals versus the frequency at which they occurred.

Figure 4:
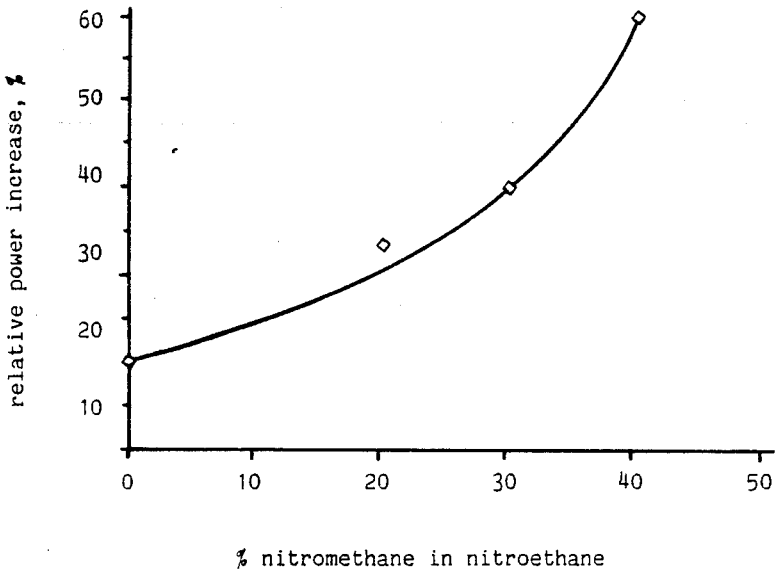
FIGS. 4 and 6 are plots of the relative power increases versus the percent nitromethane for varying amounts of nitromethane in nitroethane and 2-nitropropane, respectively.
Figure 5:
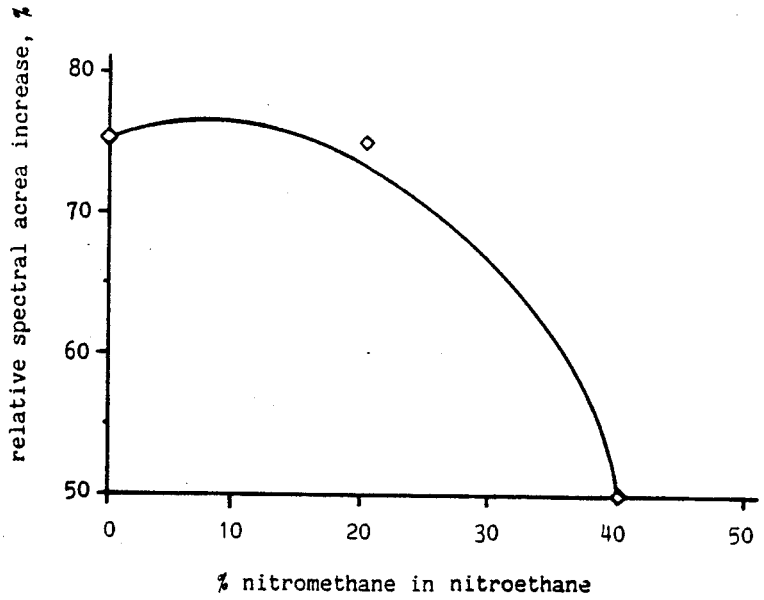
FIGS. 5 and 7 are plots of the relative spectral area increases in percent versus the percent of nitromethane, for varying amounts of nitromethane in nitroethane and 2-nitropropane, respectively.
Figure 6:
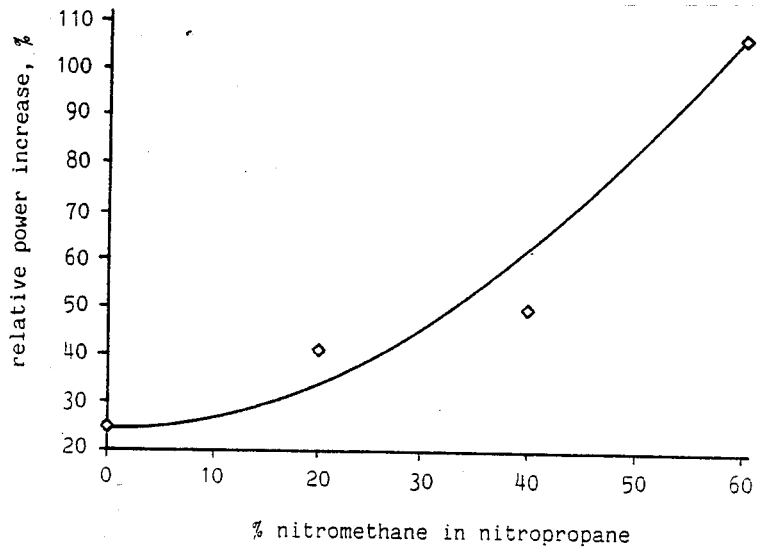
Figure 7:
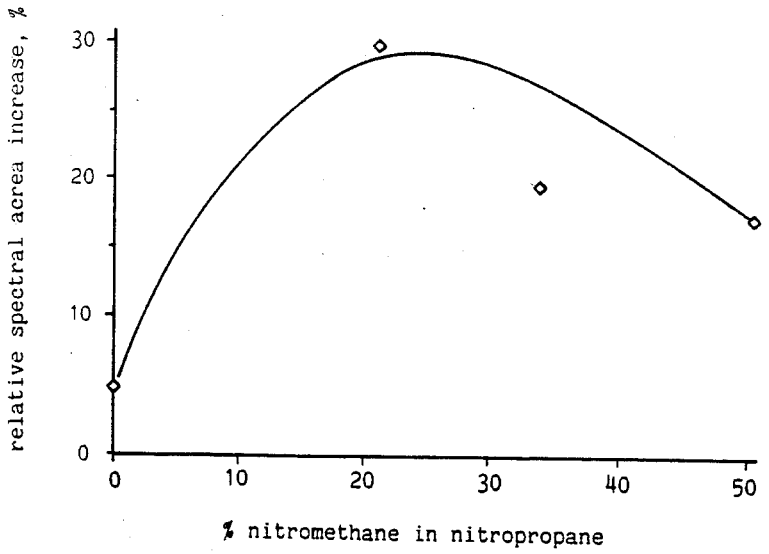

The results of the testing of the fuel compositions shown in Table 1 are illustrated in FIGS. 4 through 7. FIG. 4 is a plot of the relative power increase, in percent, using 100% methanol as a reference, versus the percent of nitromethane in nitroethane. Similarly, FIG. 6 is a plot of the relative power increase, in percent, using 100% methanol as a reference, versus the percent of nitromethane in 2-nitropropane. Both FIGS. 4 and 6 clearly illustrate that the power increased with an increase in the percentage of nitromethane in both formulations. Surprisingly, and in accordance with the present invention, FIGS. 5 and 7 illustrate that the isolated spectral area, which as discussed above is an indication of the amount of knock or detonation, decreased with an increasing amount of nitromethane in the compositions.

Thus, FIG. 5 is a plot of the relative spectral area increase, in percent, again based upon 100% methanol as the reference, versus the percent of nitromethane in nitroethane. The figure clearly shows that with the increased amount of nitromethane in the formula, the relative spectral area increase, as compared to 100% methanol, decreased continuously, for the range of nitromethane tested.

Similarly, FIG. 7 is a plot of the relative spectral area increase, in percent, based upon 100% methanol, versus the percent of nitromethane in 2-nitropropane. In the range from about zero to about 20 percent of nitromethane in 2-nitropropane, the relative spectral area increased, in comparison to 100% methanol. However, from about 20% nitromethane to about 50% nitromethane in 2-nitropropane, the maximum amount tested in the aforementioned examples, the relative spectral area increase, in comparison with 100% methanol, decreased continuously.

By comparing FIGS. 5 and 7 it is apparent that at a common comparison point such as 40% of nitromethane in the respective antiknock additive, the increased tendency to detonate, in comparison with 100% methanol, was substantially less for the formulation containing 2-nitropropane than for the formulation containing nitroethane. The curve shown on FIG. 7 would estimate that a formulation containing about 40% nitromethane in 60% 2-nitropropane would show a relative spectral area increase, in comparison with 100% methanol, of about 20 to about 25 percent. In contrast, the curve shown in FIG. 5 and as actually measured, indicates that a formulation containing 40% nitromethane and 60% nitroethane demonstrates a relative spectral area increase, in comparison with 100% methanol of about 50%.

Although it appears that under the conditions tested 2-nitropropane is more effective, on a weight basis, than nitroethane in reducing the tendency of nitromethane to detonate, it also appears that formulations containing 2-nitropropane exhibit less of a relative power increase, when compared with 100% methanol, than comparable formulations containing nitroethane. This is ascertained by comparing the curve of FIG. 6, for example, at 40% nitromethane in 2-nitropropane, with the curve of FIG. 4 at 40% nitromethane in nitroethane. The former shows a relative power increase, in comparison with 100% methanol, of about 50%, versus about 60% for the latter.

In view of the foregoing, although 2-nitropropane appears to be a more effective antiknock additive or detonation inhibitor, in comparison with nitroethane, nitroethane provides a greater relative power increase than does 2-nitropropane, for formulations containing the same amount of antiknock additive. Based upon the information at hand to date, it is not possible to determine the reason why the antiknock additives of the present invention are effective in nitromethane. One theory is that the dissociation products produced by the reaction of nitromethane with nitroethane or 2-nitropropane combine with the end-gas to make it less reactive, thus reducing the tendency of the gas to detonate. Regardless of the exact mechanism by which the antiknock additives of the present invention function in conjunction with nitromethane fuels, the results are nevertheless quite dramatic and surprising.

What is claimed is:

1. A composition useful as a fuel in an internal combustion engine comprising, by weight, from about 75 to about 99 percent of nitromethane and from about 1 to about 25 percent of an antidetonation additive selected from the group consisting of nitroethane, 2-nitropropane, and mixtures thereof.

2. The composition of claim 1 wherein the antidetonation additive is present in an amount from about 5 to about 15 percent.

3. The composition of claim 2 wherein the antidetonation additive is nitroethane.

4. The composition of claim 2 wherein the antidetonation additive is 2-nitropropane.

5. The composition of claim 3 wherein the nitroethane is present in an amount of about 10 percent.

6. The composition of claim 4 wherein the 2-nitropropane is present in an amount of about 10 percent.

7. A method for reducing the tendency of nitromethane to detonate when used as a fuel in an internal combustion engine comprising adding to the nitromethane a sufficient amount of an additive selected from the group consisting of nitroethane, 2-nitropropane, and mixtures thereof to achieve such a reduction in detonation.

8. The method of claim 7 wherein the additive is present in an amount from about 1 to about 25 percent, by weight based on the total weight of the nitromethane and additive.

9. The method of claim 8 wherein the additive is present in an amount from about 5 to about 15 percent.

10. The method of claim 9 wherein the additive is nitroethane.

11. The method of claim 10 wherein the additive is present in an amount of about 10 percent.

12. The method of claim 9 wherein the additive is 2-nitropropane.

13. The method of claim 12 wherein the additive is present in an amount of about 10 percent.

* * * * *